US008331833B2

(12) United States Patent
Akita et al.

(10) Patent No.: US 8,331,833 B2
(45) Date of Patent: Dec. 11, 2012

(54) IMAGE FORMING APPARATUS

(75) Inventors: Hiroshi Akita, Musashino (JP); Tatsuya Furuta, Fuchu (JP)

(73) Assignee: Konica Minolta Business Technologies, Inc. (JP)

( * ) Notice: Subject to any disclaimer, the term of this patent is extended or adjusted under 35 U.S.C. 154(b) by 294 days.

(21) Appl. No.: 12/906,023

(22) Filed: Oct. 15, 2010

(65) Prior Publication Data

US 2011/0097117 A1 Apr. 28, 2011

(30) Foreign Application Priority Data

Oct. 28, 2009 (JP) ..... 2009-247576

(51) Int. Cl.
*G03G 15/09* (2006.01)

(52) U.S. Cl. ..... 399/270

(58) Field of Classification Search ..... 399/267, 399/270

See application file for complete search history.

(56) References Cited

U.S. PATENT DOCUMENTS 4,885,223 A * 12/1989 Enoki et al. ..... 430/122.1
5,832,350 A * 11/1998 Kumasaka et al. ..... 399/282
2006/0222390 A1* 10/2006 Sasaki et al. ..... 399/55
2007/0071505 A1* 3/2007 Do ..... 399/270
2011/0058836 A1* 3/2011 Imura et al. ..... 399/55

FOREIGN PATENT DOCUMENTS

JP 58105275 A * 6/1983
JP 59-100471 6/1984
JP 2008-165061 7/2008

* cited by examiner

*Primary Examiner* — David Gray
*Assistant Examiner* — G. M. Hyder
(74) *Attorney, Agent, or Firm* — Squire Sanders (US) LLP

(57) ABSTRACT

Disclosed is an image forming apparatus, which makes it possible to remove the resistance reduced carriers included in the developer without abandoning normal carriers whose resistances have not reduced, even in mid-course of implementing the image forming operation. The image forming apparatus includes: a carrier adhering roller to make at least a part of carriers, included in the developer, shift and adhere onto a carrier adhering roller in response to an electric field generated between the developer conveyance member and the carrier adhering roller, a recollection roller, rotatably disposed in such a manner that the recollection roller and the carrier adhering roller oppose to each other with a gap between them, to attract carriers, currently adhered onto the carrier adhering roller, onto a circumferential surface of the recollection roller; and a scraping member, contacting the recollection roller, to scrape the adhered carriers off the circumferential surface of the recollection roller.

10 Claims, 6 Drawing Sheets

IMAGE FORMING APPARATUS

This application is based on Japanese Patent Application NO. 2009-247576 filed on Oct. 28, 2009, with the Japan Patent Office, the entire content of which is hereby incorporated by reference.

BACKGROUND OF THE INVENTION

The present invention relates to an image forming apparatus that conducts image forming operations according to the electrostatic copying process, such as a copier, a facsimile, a printer, etc.

In an image forming apparatus employing the electro-photographic method, such as a copier, a printer, etc., the electrostatic latent image is formed by applying an exposure processing to the circumferential surface of the photoreceptor drum uniformly charged in advance, so as to develop a toner image thereon by activating the developing device, and after that, the developed toner image is transferred onto the transfer material such as a recording paper sheet, etc. The transfer material onto which the toner image is transferred passes through the fixing device, to apply heat and pressure onto the transfer material so as to fix the toner image thereon.

In the image forming apparatus as abovementioned, the developing method (two component developing method), in which the developer constituting by toner and carrier (hereinafter, referred to as two component developer) is used for the operation for developing the electrostatic latent image formed on the photoreceptor drum, has been frequently employed, since the two component developing method is superior in the developing efficiency.

According to the two component developing method, by agitating the toner and carrier included in the developer concerned in the agitating chamber associated with the developing device, electric charges, generated by the friction electric charging action, are given to the toner from the carrier, so as to make the toner adhere onto the outer surface of the carrier. The carrier attached with toner, namely, the developer, is conveyed to the developing region located opposite to the photoreceptor drum by the developer conveyance member, for instance, like a developing sleeve that includes a magnetic roll therein. Then, the toner included in the developer is separated from the carrier at the developing region, and adheres onto a portion of the latent image formed on the photoreceptor drum so as to fog in the toner image. The residual toner and carrier remaining on the developer conveyance member are conveyed back to the agitating chamber, so as to reuse them for a next developing operation.

Since the toner stored in the agitating chamber is consumed and reduced according as the abovementioned developing process is repeated, the developing device employing the two component developing method is so constituted that new toner, being substantially equivalent amount of consumed toner, is supplied into the agitating chamber.

On the other hand, the carriers are reused without reducing its amount, even if the developing operation is repeated many times. However, by repeatedly agitating the carriers in the repeated usages of them, a resin coat applied on the circumferential surface of each of the carriers is gradually peeled off, and as a result, the resistance value of the carrier is decreased (resistance reduction phenomenon). Since the carrier whose resistance value has been decreased (hereinafter, referred to as the resistance reduced carrier, for simplicity) is liable to change its charging polarity when an electric charge is injected under the developing electric field, and accordingly, liable to move towards the photoreceptor member, there has been induced such a malfunction that the carrier is attached onto the solid image portion (portion to which a large amount of toner is to be adhered), or the like. Accordingly, it becomes necessary to remove the resistance reduced carriers residing within the agitating chamber therefrom.

To solve the abovementioned problem, the Tokkouhei 2-21591 (Japanese Patent Publication) sets forth a developing device employing, so called, the trickle method, in which, in the process of replenishing the agitating chamber with new toner being substantially equivalent amount of the consumed toner, new carriers associating with toner are supplied into the agitating chamber bit by bit, and by ejecting the developer overflowing from the agitating chamber when the toner and new carriers are supplied, the resistance reduced carriers residing within the agitating chamber are naturally ejected therefrom, so as to suppress the increase of the ratio of resistance reduced carriers included in the developer currently stored in the agitating chamber.

Further, Tokkai 2008-165061 (Japanese Patent Application Laid-Open Publication) sets forth a technology for selectively ejecting the resistance reduced carriers included in the developer, by making the resistance reduced carriers, included in the developer conveyed to the developing region by the developer conveyance member, selectively shift onto the photoreceptor member.

According to the technology, so called, the trickle method set forth in Tokkouhei 2-21591, for suppressing the increase of the ratio of the resistance reduced carriers included in the developer, since the developer to be abandoned includes not only the resistance reduced carriers, but also the new carriers newly supplied within a short past time, the replenishing efficiency would be deteriorated. Further, since resistance reduced carriers still remain within the developer, it has been difficult to prevent the reproduced image from suppressing occurrence of defects caused by the resistance reduced carriers, for instance, the occurrence of such the defect that some carriers adhered onto the solid color portion of the image concerned.

According to the technology set forth in Tokkai 2008-165061, by setting the skin potential (defined as a difference between the charge potential and the developing bias voltage) at a value larger than that to be employed for the normal image forming operation, the carriers, included in the developing agent conveyed to the developing region, is made to move toward the photoreceptor member. However, owing to its moving mechanism, it has been difficult to make only the resistance reduced carriers selectively move toward the photoreceptor member, and as a result, not only the resistance reduced carriers, but also non-deteriorated carriers are made to move toward the photoreceptor member, and therefore, the replenishing efficiency cannot be improved. Still further, since the residual resistance reduced carriers are still remain in the developer, it has been difficult to prevent the reproduced image from suppressing occurrence of defects caused by the resistance reduced carriers, for instance, the occurrence of such the defect that some carriers adhered onto the solid color portion of the image concerned. Yet further, since it is necessary to set the skin potential at a value larger than that to be employed for the normal image forming operation, there has arisen another problem that it is impossible to remove the resistance reduced carriers, while conducting the normal image forming operation.

SUMMARY OF THE INVENTION

To overcome the abovementioned drawbacks in conventional image forming apparatus, it is one of objects of the present invention to provide an image forming apparatus, which makes it possible to remove the resistance reduced carriers included in the developer without abandoning the normal carriers whose resistances have not reduced, even in mid-course of implementing the image forming operation.

Accordingly, at least one of the objects of the present invention can be attained by the image forming apparatus described as follows.

(1) According to an image forming apparatus reflecting an aspect of the present invention, the image forming apparatus that is provided with a photoreceptor member that rotates while bearing an electrostatic latent image thereon, and a developing device to develop the electrostatic latent image formed on the photoreceptor member, comprises: a developer conveyance member, rotatably disposed inside the developing device in such a manner that the developer conveyance member and the photoreceptor member oppose to each other at a first opposing position while placing a first predetermined gap between them, and bearing developer constituted by toner and carriers, thereon, so as to convey the developer to the first opposing position, wherein the electrostatic latent image, borne on the photoreceptor member, is developed at the first opposing position between the photoreceptor member and the developer conveyance member, by shifting the toner included in the developer, borne on the developer conveyance member, onto the photoreceptor member in response to a first electric field generated at the first predetermined gap between the photoreceptor member and the developer conveyance member; a carrier adhering roller, rotatably disposed in such a manner that the carrier adhering roller and the developer conveyance member oppose to each other at a second opposing position while placing a second predetermined gap between them, so as to make at least a part of the carriers, included in the developer currently borne on the developer conveyance member, shift and adhere onto the carrier adhering roller in response to a second electric field generated at the second predetermined gap between the developer conveyance member and the carrier adhering roller; a recollection roller, rotatably disposed in such a manner that the recollection roller and the carrier adhering roller oppose to each other at a third opposing position while placing a third predetermined gap between them, to generate a magnetic field at the third opposing position so as to attract adhered carriers, currently adhered onto the carrier adhering roller, onto a circumferential surface of the recollection roller; and a scraping member, contacting the recollection roller, to scrape the adhered carriers off the circumferential surface of the recollection roller.

(2) According to another aspect of the present invention, in the image forming apparatus recited in item 1, the second opposing position is located upstream the first opposing position in a rotating direction of the developer conveyance member.

(3) According to still another aspect of the present invention, in the image forming apparatus recited in item 1 or item 2, a strength of the second electric field to be applied to the second predetermined gap, located at the second opposing position, is set at such a value that is greater than that of the first electric field to be generated between a solid exposure section of the photoreceptor member and the developer conveyance member.

(4) According to still another aspect of the present invention, in the image forming apparatus recited in any one of items 1-3, amount of developer to be borne and conveyed by the photoreceptor member is regulated by the carrier adhering roller.

(5) According to a carrier recollecting method reflecting yet another aspect of the present invention, the carrier recollecting method, which is to be employed for an image forming apparatus that is provided with a photoreceptor member that rotates while bearing an electrostatic latent image thereon, and a developing device that includes a developer conveyance member, rotatably disposed inside the developing device in such a manner that the developer conveyance member and the photoreceptor member oppose to each other at a first opposing position while placing a first predetermined gap between them, and bearing developer constituted by toner and carriers, thereon, so as to convey the developer to the first opposing position, wherein the electrostatic latent image, borne on the photoreceptor member, is developed at the first opposing position between the photoreceptor member and the developer conveyance member, by shifting the toner included in the developer, borne on the developer conveyance member, onto the photoreceptor member in response to a first electric field generated at the first predetermined gap between the photoreceptor member and the developer conveyance member, the carrier recollecting method comprises: making at least a part of the carriers, included in the developer currently borne on the developer conveyance member, shift and adhere onto a carrier adhering roller, rotatably disposed in such a manner that the carrier adhering roller and the developer conveyance member oppose to each other at a second opposing position while placing a second predetermined gap between them, in response to a second electric field generated at the second predetermined gap between the developer conveyance member and the carrier adhering roller; attracting adhered carriers, currently adhered onto the carrier adhering roller, onto a circumferential surface of a recollection roller, rotatably disposed in such a manner that the recollection roller and the carrier adhering roller oppose to each other at a third opposing position while placing a third predetermined gap between them, and generating a magnetic field at the third opposing position; and scraping the adhered carriers off the circumferential surface of the recollection roller by employing a scraping member currently contacting the recollection roller.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
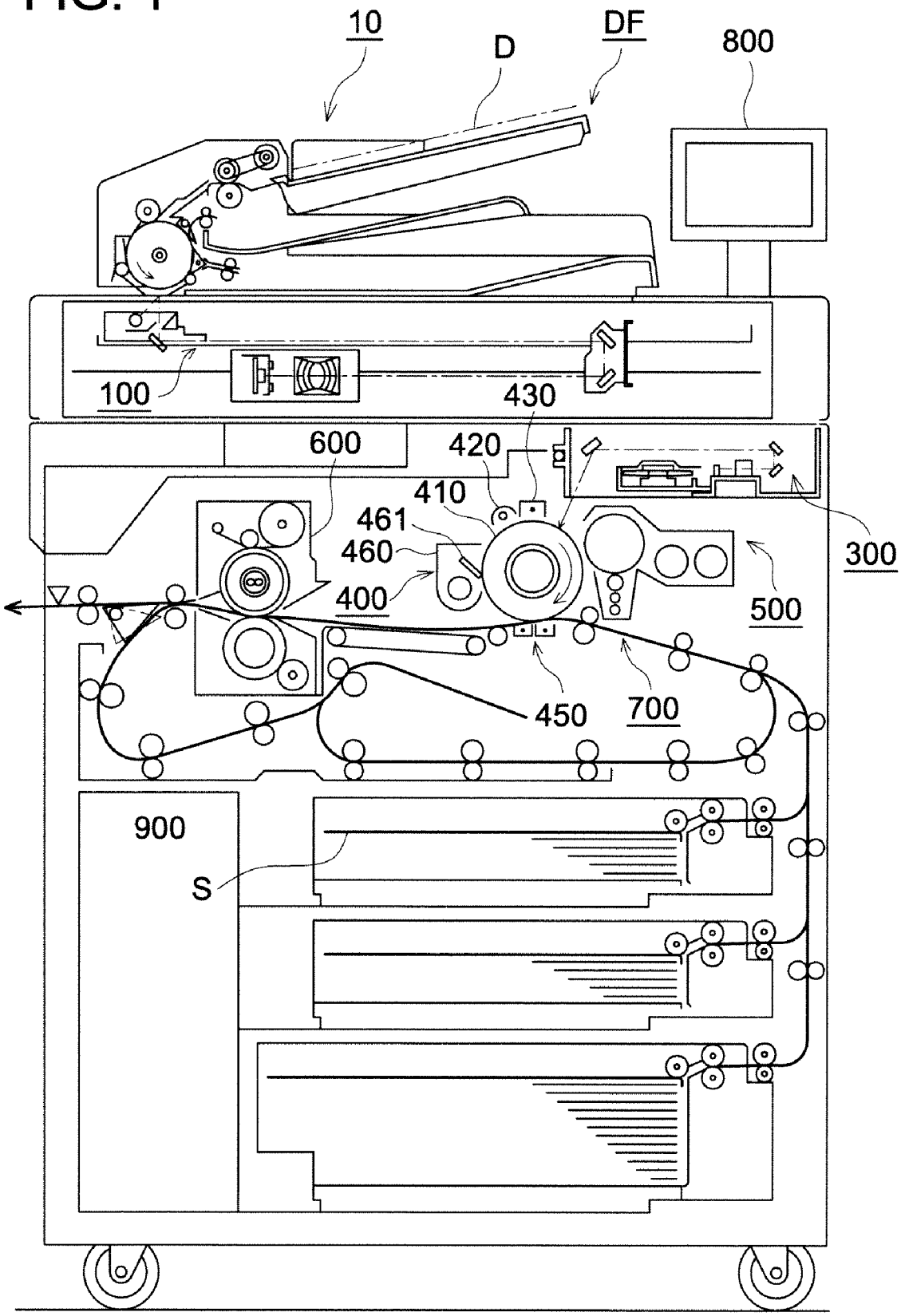
FIG. 1 shows an explanatory schematic diagram indicating an image forming apparatus embodied in the present invention.

Referring to the drawings, an image forming apparatus, serving as an example of the embodiments of the present invention, will be detailed in the following. In this connection, the scope of the present invention is not limited to the embodiment described as follow.

FIG. 1 shows an explanatory schematic diagram indicating an image forming apparatus embodied in the present invention.

An image forming apparatus 10 prints an image and/or characters onto a recording paper sheet through the processes in conformity with the electro-photographic method.

The image forming apparatus 10 is provided with a document reading section 100, an image processing section (not shown in the drawings), an image writing section 300, an image forming section 400, a transferring section 450, a developing device 500, a fixing section 600, a paper sheet conveyance section 700, an display operating section 800, and a controlling section 900.

The operator can input various kinds of conditions for operating the image forming apparatus 10, such as a number of recording paper sheets to be used for the image forming operation concerned, a size of the paper sheets, etc., as job information from the display operating section 800. Further, the display operating section 800 is provided with a start button, so as to make it possible to start the image forming operation of the image forming apparatus 10 on the basis of the inputted job information, by turning ON the start button.

The 900 controls the image forming operations, to be conducted by the image forming apparatus 10, by referring to the job information inputted from the display operating section 800.

An automatic document feeder DF is mounted on the upper side of the image forming apparatus 10. A document D placed on a document platform (platen) of the automatic document feeder DF is conveyed in the direction indicated by the arrow shown in FIG. 1, and an optical system of the document reading section 100 reads an image on the document D so as to acquire image information.

Successively, the image processing section 200 applies various kinds of image processing to the image information above-acquired, as needed, an then, transmits the processed image data to the image writing section 300.

Receiving the processed image data transmitted from the image processing section 200, the image writing section 300 irradiates a laser beam, serving as an output light emitted from a semiconductor laser and modulated on the basis of the processed image data, onto a photoreceptor drum 410 provided in the image forming section 400.

The image forming section 400 is provided with the photoreceptor drum 410, an eraser lamp 420, a charging device 430 and a cleaning device 460.

After the eraser lamp 420 irradiates a light onto the photoreceptor drum 410 so as to remove electric charges from the circumferential surface thereof, the charging device 430 uniformly gives electric charges onto the circumferential surface of the photoreceptor drum 410, which is driven by a driving mechanism (not shown in the drawings) so as to rotate it in the direction indicated by the arrow shown in FIG. 1, and then, the image writing section 300 irradiates the laser beam, modulated by the processed image data, onto the photoreceptor drum 410. Then, by receiving the laser beam (output light) emitted from the image writing section 300, a latent image based on the processed image data is formed on the circumferential surface of the photoreceptor drum 410. Namely, the photoreceptor drum 410 serves as a photoreceptor member that rotates while bearing an electrostatic latent image thereon.

Further, the electrostatic latent image formed on the photoreceptor drum 410 is developed by the developing device 500, so as to form a toner image thereon. The configurations and operations of the developing device 500 will be detailed later on.

Successively, the toner image formed on the circumferential surface of the photoreceptor drum 410 is transferred onto a recording paper sheet S, conveyed by the paper sheet conveyance section 700, by activating the transferring section 450. Still successively, the recording paper sheet S, having the transferred toner image thereon, is further conveyed into the fixing section 600, so as to fix the toner image onto the recording paper sheet S. Yet successively, the recording paper sheet S, onto which the toner image is fixed, is ejected outside the image forming apparatus 10.

After that, a cleaning blade 461 of the cleaning device 460 is made to contact the circumferential surface of the photoreceptor drum 410 to scrub the circumferential surface of the photoreceptor drum 410 so as to remove the residual toner remaining thereon.

After the operation for transferring the toner image onto the recording paper sheet S is completed and the residual toner remaining on the circumferential surface of the photoreceptor drum 410 is removed by activating the cleaning device 460, the electric charges are removed, and then, uniformly given from/to the circumferential surface of the photoreceptor drum 410 by sequentially activating the eraser lamp 420 and the charging device 430, so as to provide the photoreceptor drum 410 for forming a next electrostatic latent image.

Now, the developing device 500, which is to be mounted into the image forming apparatus embodied in the present invention as the first embodiment, will be detailed in the following.

Figure 2:
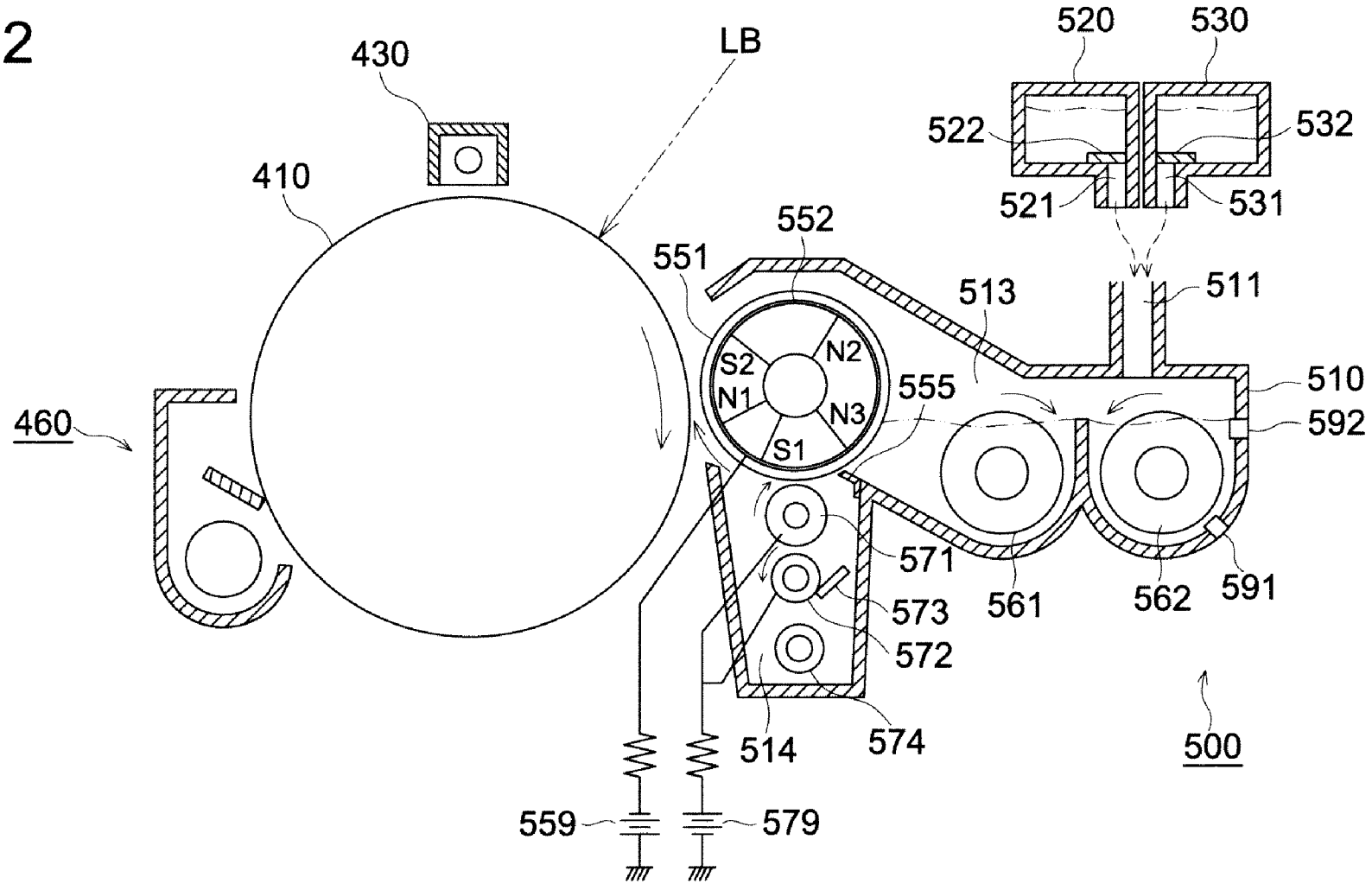
FIG. 2 shows an explanatory schematic diagram for explaining configurations and operations of a developing device.

FIG. 2 shows an explanatory schematic diagram for explaining the configurations and the operations of the developing device 500.

Numeral 510 indicates a housing of the developing device 500, which serves as a developer accommodating chamber 513 for accommodating the developer being a mixture of toner and carriers (two components developer), therein, and also for agitating the two components developer accommodated in the chamber.

Further, disposed in the housing 510 are: a developing sleeve 551 serving as a developer conveyance member; a magnet roll 552 disposed inside the developing sleeve 551 so as to serve as a magnetic field generating member that includes plural magnetic poles; a developer layer regulating member 555 to regulate a layer thickness of the developer, which is attached onto the circumferential surface of the developing sleeve 551 and is conveyed thereby; and a pair of agitating screws 561, 562 to agitate the developer accommodated in the developer accommodating chamber 513.

Numeral 520 indicates a toner hopper to store fresh toner therein, which is indicated in an upper space of the schematic diagram shown in FIG. 2, while numeral 530 indicates a carrier hopper to store fresh carriers. In response to a status of the residual developer currently stored in the developer accommodating chamber 513, the toner and/or the carriers, respectively accommodated in the toner hopper 520 and the carver hopper 530, are fed into the developer accommodating chamber 513 through feeding paths (not shown in the drawings).

Further, numeral 591 indicates a toner density detecting sensor to detect a toner density of the developer residing in the developer accommodating chamber 513, while numeral 592 indicates a developer upper level detecting sensor to detect a total amount of developer currently residing in the developer accommodating chamber 513.

The pair of agitating screws 561, 562 are rotated in directions being reverse to relative to each other, so as not only to mix the toner and carriers with each other by agitating the developer residing in the developer accommodating chamber 513, but also to give electrostatic charge to the developer generated by the physical frictions between them.

The developing sleeve 551 is made of, for instance, a nonmagnetic stainless steel and formed in a cylindrical shape, and disposed at a position opposing to the circumferential surface of the photoreceptor drum 410 while maintaining a predetermined gap between them (0.3 mm in the present embodiment), so that the developing sleeve 551 is rotated in a direction (in the clockwise direction as indicated by the arrow shown in FIG. 2) being reverse to the rotating direction of the photoreceptor drum 410, which is driven to rotate (in the clockwise direction as indicated by the other arrow shown in FIG. 2) by a rotation driving section (not shown in the drawings), at such a position that both the photoreceptor drum 410 and the developing sleeve 551 are opposing to each other.

The magnet roll 552 is fixed inside the developing sleeve 551 in a concentric manner relative to the developing sleeve 551. The magnet roll 552 includes a plurality of magnetic poles, which are, for instance, magnetic poles N1, N2, N3, S1, S1 and alternately disposed along its circumferential surface, so as to exert the magnetic force over the circumferential surface of the developing sleeve 551.

The magnetic force generated by the magnet roll 552 attracts the developer residing in the developer accommodating chamber 513 towards the developing sleeve 551, so that the carriers, attached with the toner, adhere onto the circumferential surface of the developing sleeve 551.

Successively, the developing sleeve 551, currently rotating, conveys the developer, adhered on its circumferential surface, to the opposing position (developing region) between the developing sleeve 551 and the photoreceptor drum 410.

The developer layer regulating member 555 is attached onto the housing 510 and disposed at such a position that a gap between the free edge portion of the developer layer regulating member 555 and the circumferential surface of the developing sleeve 551 is set at a predetermined gap (0.25 mm in the present embodiment), to regulate the thickness of the developer layer, namely, the layer thickness, within a predetermined range, so as to regulate the developer conveyance amount. In present embodiment, the developer conveyance amount of the developing sleeve 551 is set at 200 g/m$^2$.

After the circumferential surface of the photoreceptor drum 410 has been uniformly charged in the minus polarity by the charging action of the charging device 430, when the image writing section 300 irradiates an output light LB, modulated on the basis of the processed image data, onto the circumferential surface of the photoreceptor drum 410 (writing operation), since the electric charge amount at the irradiated portion varies with the intensity of the output light LB, a latent image based on the processed image data is formed thereon.

In this connection, in the present embodiment, the voltage of the electric charge potential, to be generated by the charging device 430 on the circumferential surface of the photoreceptor drum 410, is set at −600 V.

When the image writing section 300 irradiates the output light LB onto the photoreceptor drum 410, which is currently rotating, since the electric charge potential on the circumferential surface thereof varies with the intensity of the light irradiated from the image writing section 300 (amount of exposure), the latent image can be formed. With respect to electric potentials over the circumferential surface of the photoreceptor drum 410, the electric potential at a portion, onto which the output light LB is not irradiated (background area), is −600 V, while the other electric potential at another portion, onto which the output light LB is irradiated (solid exposure section) at its maximum strength, is −100 V.

Further, a bias voltage source 559 applies a developing bias voltage to the developing sleeve 551. In the present embodiment, the developing bias voltage is set at −500 V. According to the rotating action of the photoreceptor drum 410, at the time when the latent-image formed section arrives at the position opposing to the developing sleeve 551 (developing region), the toner, included in the developer conveyed to the developing region by the rotating action of the developing sleeve 551, is separated from the carriers and moves onto the exposure section of the photoreceptor drum 410. At this time, the carriers do not move onto the photoreceptor drum 410, since the carriers are still attracted onto the developing sleeve 551 by the magnetic force generated by the magnet roll 552.

An amount of toner to be shifted onto the photoreceptor drum 410 corresponds to the surface potential of the photoreceptor drum 410, namely, the latent image currently formed on the photoreceptor drum 410, and as a result, the latent image is converted to the toner image, serving as a visible image.

Successively, after passing through the developing region, the residual toner and carriers, which still remain on the circumferential surface of the developing sleeve 551 without moving onto the photoreceptor drum 410, are separated from the developing sleeve 551 by the repelling action of the magnet roll 552 and return to the developer accommodating chamber 513 serving as the agitating chamber. Then, the separated residual toner and carriers are agitated and mixed with the developer, currently accommodated in the developer accommodating chamber 513, by activating the agitating screw 561, so as to provide the newly mixed developer for the next developing operation.

As abovementioned, although the carriers can be repeatedly used without being consumed, the toner is gradually consumed in the developing operation. Therefore, according as the developing operation is repeated, an amount of toner residing in the developer accommodating chamber 513 decreases.

The upper top plate of the developer accommodating chamber 513 is provided with a developer replenishing opening 511 serving as an opening for supplying new developer. The developer supplying opening 511 is coupled to the toner hopper 520 serving as a toner accommodating section, and the carrier hopper 530 serving as a carrier accommodating section, through replenishing paths (not shown in the drawings), so that, in response to the status of the residual developer currently stored in the developer accommodating chamber 513, the toner and/or the carriers, respectively accommodated in the toner hopper 520 and the carrier hopper 530, are replenished into the developer accommodating chamber 513 through the developer replenishing opening 511.

Successively, the toner and/or the carriers replenished through the developer replenishing opening 511 are agitated and mixed with the developer, currently accommodated in the developer accommodating chamber 513, by activating the pair of agitating screws 561, 562, so as to provide the newly mixed developer having a uniform toner density.

In this connection, since the toner accommodating in the developer accommodating chamber 513 is consumed in the developing operation for moving the toner concerned onto the photoreceptor drum 410, the amount of toner concerned gradually decreases according as the developing operation is repeated plural times. On the other hand, since the carriers are repeatedly used without being consumed, the member of carriers concerned does not decrease, even if the developing operation is repeated plural times. Accordingly, by repeating the developing operation, the ratio of toner included in the developer (mixture of toner and carriers) residing in the developer accommodating chamber 513 (toner density) is lowered. If the toner density of the developer is lowered, it becomes impossible to appropriately achieve the developing operation.

At the time when the toner density detecting sensor 591 detects the fact that the toner density in the developer accommodating chamber 513 has reached to a level lower than a predetermined toner density, the toner, accommodated in the toner hopper 520, is fed into the developer accommodating chamber 513.

In the present embodiment, at the time when the toner density detecting sensor 591 detects the fact that the toner density in the developer accommodating chamber 513 has reached to the level being equal to or smaller than the predetermined toner density, a shutter 522, currently closing a toner emission opening 521, is activated to open the toner emission opening 521, so as to feed the toner accommodated in the toner hopper 520 to the developer accommodating chamber 513 through the toner feeding path (not shown in the drawings). By supplying the toner into the developer accommodating chamber 513, the ratio of toner included in the developer residing in the developer accommodating chamber 513 is heightened, and as a result, the toner density increases.

Then, at the time when the toner density in the developer accommodating chamber 513 has reached to the level being equal to or greater than the predetermined toner density, the shutter 522, currently opening the toner emission opening 521, is activated to close the toner emission opening 521, so as to stop the toner feeding operation from the toner hopper 520.

As abovementioned, the developing device 500 is so constituted that, by supplying toner into the developer accommodating chamber 513 while taking the detected toner density of the developer residing in the developer accommodating chamber 513 into account, the toner density of the developer is maintained within a predetermined range.

In this connection, the carriers are supplied from the carrier hopper 530 at the time when the developer upper level detecting sensor 592 detects the fact that an upper level of the developer currently accommodated in the developer accommodating chamber 513 has dropped to a height lower than a predetermined height. With respect to the abovementioned carrier supplying operation will be further detailed later on.

In the image forming operation (developing operation), the carriers are repeatedly reused without being consumed. However, by repeatedly agitating the carriers in the repeated usages of them, a resin coat applied on the circumferential surface of each of the carriers is gradually peeled off, and as a result, the resistance value of the carrier is decreased.

Since the resistance reduced carrier is liable to move towards the photoreceptor drum 410, there has been easily generated such a defect that the carrier moves towards the solid exposure section of the latent image.

The image forming apparatus, embodied in the present invention, is provided with a carrier adhering roller 571, a recollection roller 572 and a scraper 573, so as to make it possible to remove the resistance reduced carriers from the developer residing in the developer accommodating chamber 513.

The carrier adhering roller 571 is made of, for instance, a nonmagnetic stainless steel, and formed in a cylindrical shape. The carrier adhering roller 571 is disposed at such a position that is located upstream the opposing position, at which the developing sleeve 551 and the photoreceptor drum 410 oppose to each other, in the rotating direction of the developing sleeve 551, while maintaining a predetermined gap between the carrier adhering roller 571 and the developing sleeve 551 (0.25 mm in the present embodiment). Further, the carrier adhering roller 571 is rotated in a direction (in the clockwise direction as indicated by the arrow shown in FIG. 2) being reverse to the rotating direction of the developing sleeve 551, which is driven to rotate (in the clockwise direction as indicated by the other arrow shown in FIG. 2) by a rotation driving section (not shown in the drawings), at such a position that both the developing sleeve 551 and the carrier adhering roller 571 are opposing to each other.

A DC (Direct Current) electric power source 579 applies a voltage (+200 V, in the present embodiment) onto the carrier adhering roller 571.

In this connection, it is preferable that the voltage to be applied onto the carrier adhering roller 571 is established in such a manner that the electric field between the developing sleeve 551 and the carrier adhering roller 571 becomes stronger than that between the developing sleeve 551 and the solid exposure section on the photoreceptor drum 410.

It is possible to represent the intensity of the electric field between two members, which are opposing to each other, by a value derived from dividing an electric potential difference between the two members by a distance between the two members concerned.

As aforementioned, the electric potential at the solid exposure section of the photoreceptor drum 410 is −100 V, and the developing sleeve 551 rotates while maintaining the gap of 0.3 mm with respect to the circumferential surface of the photoreceptor drum 410. Accordingly, the intensity of the electric field $E_{S\text{-}D}$ between the developing sleeve 551 and the photoreceptor drum 410 can be found as follow.

$$E_{S\text{-}D}=\{(-500\text{V})-(-100\text{V})\}/0.3\text{ mm}=-1333\times10^3\text{ V/m}$$

Further, the DC electric bias voltage to be applied onto the developing sleeve 551, embodied in the present invention, is −500 V, and the voltage to be applied onto the carrier adhering roller 571 is +200 V, and the carrier adhering roller 571 rotates while maintaining the gap of 0.25 mm with respect to the circumferential surface of the developing sleeve 551. Accordingly, the intensity of the electric field $E_{S\text{-}B}$ between the developing sleeve 551 and the carrier adhering roller 571 can be found as follow.

$$E_{S\text{-}B}=\{(-500\text{V})-(+200\text{V})\}/0.25\text{ mm}=-2800\times10^3\text{ V/m}$$

As abovementioned, the developing device 500, embodied in the present invention, is so constituted that the intensity of electric field $E_{S\text{-}B}$(=−2800×10³ V/m) between the developing sleeve 551 and the carrier adhering roller 571 is greater than the other intensity of electric field $E_{S-D}$(=−1333×10$^3$ V/m) between the developing sleeve 551 and the solid exposure section on the photoreceptor drum 410.

According to the abovementioned configuration of the developing device 500 embodied in the present invention, the resistance reduced carriers, among the carriers to be conveyed while adhering onto the circumferential surface of the developing sleeve 551, are forcibly moved towards the circumferential surface of the carrier adhering roller 571 at the opposing position between the developing sleeve 551 and the carrier adhering roller 571, so as to remove the resistance reduced carriers from the circumferential surface of the developing sleeve 551.

In this connection, not only the resistance reduced carriers, but also toner currently adhering to the resistance reduced carriers concerned, are moved onto the carrier adhering roller 571. The toner and the resistance reduced carriers, currently moved onto the circumferential surface of the carrier adhering roller 571, are conveyed to another opposing position between the carrier adhering roller 571 and the recollection roller 572 by the rotating action of the carrier adhering roller 571.

The recollection roller 572 is a magnetic roller in which plural magnetic poles are arranged, while maintaining a predetermined gap (0.2 mm in the present embodiment) with respect to the circumferential surface of the carrier adhering roller 571, so that the recollection roller 572 is rotated in a direction (in the anticlockwise direction as indicated by the arrow shown in FIG. 2) being same as the rotating direction of the carrier adhering roller 571, which is driven to rotate (in the clockwise direction as indicated by the other arrow shown in FIG. 2) by a rotation driving section (not shown in the drawings), at such a position that both the recollection roller 572 and the carrier adhering roller 571 are opposing to each other.

The voltage, being same as that applied to the carrier adhering roller 571, is applied to the recollection roller 572. In the present embodiment, since the voltage applied to the carrier adhering roller 571 is +200 V, the same voltage of +200 V is also applied to the recollection roller 572 from the DC electric power source 579 serving as a common voltage source. In this connection, it is also applicable that two voltages, generated by two electric power sources being independent from each other, are applied to the carrier adhering roller 571 and the recollection roller 572, respectively, and the two voltages are not necessary the same as each other.

The recollection roller 572 generates the magnetic force to attract the resistance reduced carriers form the carrier adhering roller 571 at the opposing position with the carrier adhering roller 571, so as to convey the resistance reduced carriers to the position at which the scraper 573 is disposed.

The scraper 573 is a plate-shaped member having a flexible property, for instance, made of phosphor bronze, and is disposed in such a manner that the leading edge portion of the scraper 573 is made to contact the circumferential surface of the recollection roller 572. Accordingly, the scraper 573 scrubs the circumferential surface of the recollection roller 572, which is currently rotating, so as to scrape the resistance reduced carriers, conveyed while adhering onto the recollection roller 572, off the recollection roller 572.

Successively, the resistance reduced carriers, scraped off the recollection roller 572, are temporarily stored in a carrier storing chamber 514, and then, ejected from the carrier storing chamber 514 through an ejecting conveyance path (not shown in the drawings) by activating a carrier ejecting screw 574.

In this connection, although some residual toner still remain on the circumferential surface of the carrier adhering roller 571 even after passing through the opposing position with the recollection roller 572, since the residual toner again return to the developing sleeve 551 at the opposing position with the developing sleeve 551 so as to reuse it for the next developing operation, the residual toner is not to be abandoned associating with the removal of the resistance reduced carriers.

As described in the foregoing, according to the developing device 500 embodied in the present invention as the first embodiment, the carrier adhering roller 571, which is disposed in such a manner that the carrier adhering roller 571 and the developing sleeve 551 oppose to each other and onto which the predetermined voltage is applied, makes the resistance reduced carriers, included in the carriers born by the developing sleeve 551, move to and adhere onto the carrier adhering roller 571.

Successively, by rotating the recollection roller 572 to which a predetermined voltage is applied and which is disposed opposite the carrier adhering roller 571, the resistance reduced carriers, moving to and currently adhering onto the carrier adhering roller 571, are made to adhere onto the recollection roller 572. Then, the resistance reduced carriers, residing on the recollection roller 572, are scraped off the circumferential surface of recollection roller 572 by the scraping action of the scraper 573, and ejected outside the developing device 500.

As abovementioned, according to the developing device 500 embodied in the present invention, since the resistance reduced carriers can be removed from the developer residing in the developer accommodating chamber 513, through the developing sleeve 551, the carrier adhering roller 571 and the recollection roller 572, it becomes possible to prevent an occurrence of defect caused by the resistance reduced carriers. Further, since it is possible to conduct the operation for removing resistance reduced carriers while performing the image forming operation, it becomes unnecessary to halt the image forming operation during the operation for removing the resistance reduced carriers or the like, it becomes possible to prevent the image forming operation from deteriorating its productivity.

Still further, in the present embodiment, the opposing position between the carrier adhering roller 571 and the developing sleeve 551 is disposed at such the position that is located upstream the other opposing position between the developing sleeve 551 and the photoreceptor drum 410 in the rotating direction of the developing sleeve 551. By arranging the two different opposing positions as abovementioned, the resistance reduced carriers, included in the developer to be born and conveyed by the developing sleeve 551, are removed, before the resistance reduced carriers are conveyed to the opposing position between the developing sleeve 551 and the photoreceptor drum 410, namely, the developing region. Therefore, it becomes possible to preferably prevent the reproduced image from having such the defect that the resistance reduced carrier adheres onto the solid image portion.

Still further, the voltage to be applied to the carrier adhering roller 571 is set at such a value that the intensity of the electric field $E_{S-B}$ between the carrier adhering roller 571 and the developing sleeve 551, at the opposing position between the carrier adhering roller 571 and the developing sleeve 551, becomes stronger than the other intensity of the electric field $E_{S-D}$ at the solid exposure section on the photoreceptor drum 410. By setting the voltage concerned as abovementioned, it becomes possible to make the resistance reduced carriers move from the developing sleeve 551 to the carrier adhering roller 571, more preferably than ever.

According as the resistance reduced carriers are removed, an amount of the carriers currently accommodated in the developer accommodating chamber 513 gradually decreases.

Further, according as the amount of the carriers currently accommodated in the developer accommodating chamber 513 gradually decreases, a total amount of the developer currently accommodated in the developer accommodating chamber 513 also decreases.

The decrease of the total amount of the developer currently accommodated in the developer accommodating chamber 513 will result in a drop of the height of the upper level of the developer accommodated in the developer accommodating chamber 513. Then, at the time when the developer upper level detecting sensor 592 detects the fact that the upper level of the developer is dropped to a level lower than a predetermined height, a carrier emission opening 531 is opened by activating a shutter 532, currently closing the carrier emission opening 531 of the carrier hopper 530, so as to feed new carriers (fresh, normal resin-coated carriers) into the developer accommodating chamber 513 through the toner feeding path (not shown in the drawings).

Then, at the time when the total amount of the developer, currently accommodated in the developer accommodating chamber 513, increases to such extent that the upper level of the developer is equal to or higher than the predetermined height, the shutter 532 is activated to close the carrier emission opening 531 so as to stop the carrier feeding operation from the carrier hopper 530.

Although the toner density of the developer, accommodated in the developer accommodating chamber 513, decreases according as the new carriers are supplied, at the time when the toner density detecting sensor 591 detects the fact that the toner density in the developer accommodating chamber 513 has reached to the level being equal to or smaller than the predetermined toner density, new toner is fed from the toner hopper 520, so as to keep the toner density, accommodated in the developer accommodating chamber 513, at a value within the predetermined range.

In this connection, the developing device 500, embodied in the present invention as the first embodiment, is provided with the developer layer regulating member 555 to regulate the thickness of the developer layer, which is to be attached and conveyed onto/by the developing sleeve 551, at a value within the predetermined range. However, it is also possible to employ the carrier adhering roller 571 for regulating the thickness of the developer layer, which is to be attached and conveyed onto/by the developing sleeve 551, so as to regulate the developer conveyance amount of the developing sleeve 551 at a predetermined value, without having the developer layer regulating member 555.

An image forming apparatus, embodied in the present invention as the second embodiment, is configured by replacing the developing device 500, employed in the image forming apparatus serving as the first embodiment of the present invention, with a developing device 500A detailed later.

The configurations and operations of the image forming apparatus embodied in the present invention as the second embodiment, is substantially the same as that of the other image forming apparatus embodied in the present invention as the first embodiment, except the developing device. Accordingly, in the following descriptions, explanations for the sections other than the developing device will be omitted, and the configurations and operations in regard to the developing device will be mainly detailed.

Figure 3:
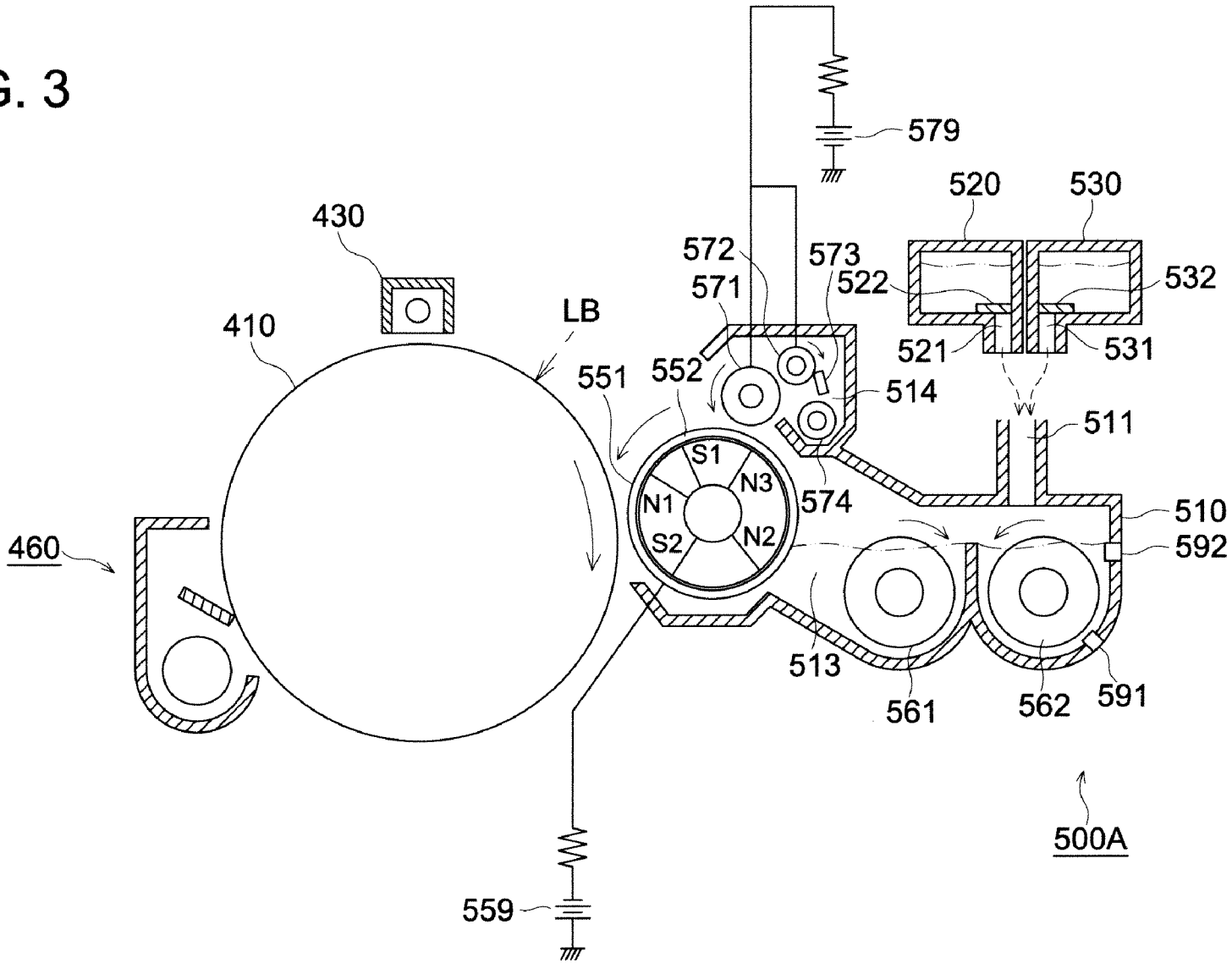
FIG. 3 shows an explanatory schematic diagram for explaining configurations and developing operations of a developing device to be incorporated in an image forming apparatus embodied in the present invention as the second embodiment.

FIG. 3 shows an explanatory schematic diagram for explaining the configurations and the developing operations of the developing device 500A to be incorporated in the image forming apparatus embodied in the present invention as the second embodiment.

As shown in FIG. 3, the developing device 500A is configured as described in the following.

In the developing device 500A, numeral 510 indicates a housing of the developing device 500A, which serves as a developer accommodating chamber 513 for accommodating the developer being a mixture of toner and carriers (two components developer), therein, and also for agitating the two components developer accommodated in the chamber.

Further, disposed in the housing 510 are: a developing sleeve 551; a magnet roll 552 disposed inside the developing sleeve 551 so as to serve as a magnetic field generating member that includes fixed magnetic poles; a pair of agitating screws 561, 562 to agitate the developer accommodated in the developer accommodating chamber 513; a toner density detecting sensor 591; a developer upper level detecting sensor 592; a carrier adhering roller 571; a recollection roller 572; a scraper 573 and carrier ejecting screw 574.

In this connection, the rotating direction of the developing sleeve 551 in the developing device 500A is set at an anti-clockwise direction, being a reverse direction of the rotating direction of the other developing sleeve 551 in the developing device 500. Further, the carrier adhering roller 571 is disposed at such a position that is located upstream the opposing position between the developing sleeve 551 and the photoreceptor drum 410 in the rotating direction thereof.

Further, a toner hopper 520 and a carrier hopper 530 are disposed at the upper space located above the housing 510 as indicated in the schematic diagram shown in FIG. 3, so that new toner and/or new carriers are respectively fed from the toner hopper 520 and/or the carrier hopper 530 through feeding paths (not shown in the drawings), in response to the status of the developer accommodated in the developer accommodating chamber 513.

In both the developing device 500 serving as the first embodiment of the present invention and the developing device 500A serving as the second embodiment of the present invention, the contents and the configurations of the functional members, attached with the names and/or the reference numerals being common between both of them, are the same as each other, and are disposed in the same positional relationships, respectively, unless otherwise specified.

For instance, a gap between the developing sleeve 551 and the photoreceptor drum 410, another gap between developing sleeve 551 and the carrier adhering roller 571, still another gap between the carrier adhering roller 571 and the recollection roller 572, are established at 0.3 mm, 0.25 mm and 0.2 mm, respectively.

Other than the above, since the functional members, attached with the names and/or the reference numerals being common with those in the developing device 500 serving as the first embodiment of the present invention, have been detailed in the aforementioned descriptions for e first embodiment, the duplicated descriptions will be omitted.

In this connection, the voltages to be respectively applied to the developing sleeve 551, the carrier adhering roller 571 and the recollection roller 572 in the developing device 500A serving as the second embodiment of the present invention, are the same as the voltages to be respectively applied to the developing sleeve 551, the carrier adhering roller 571 and the recollection roller 572 in the developing device 500 serving as the first embodiment of the present invention, and are −500 V, +200 V and +200 V, respectively. Further, the electric potential at a portion (background area) on the photoreceptor drum 410, uniformly charged by the charging device 430, is −600 V, while the other electric potential at another portion (solid exposure section) onto which the output light LB is irradiated at its maximum strength, is −100 V.

Accordingly, the intensity of the electric field $E_{SD}$ between the developing sleeve 551 and the solid exposure section on the photoreceptor drum 410 can be found as follow.

$$E_{S\text{-}D}=\{(-500\text{V})-(-100\text{V})\}/0.3\text{ mm}=-1333\times10^3\text{ V/m}$$

Further, the intensity of the electric field $E_{S\text{-}B}$ between the developing sleeve 551 and the carrier adhering roller 571 can be found as follow.

$$E_{S\text{-}B}=\{(-500\text{V})-(+200\text{V})\}/0.25\text{ mm}=-2800\times10^3\text{ V/m}$$

Accordingly, the developing device 500A, embodied in the present invention as the second embodiment, is so constituted that the intensity of electric field $E_{S\text{-}B}$ between the developing sleeve 551 and the carrier adhering roller 571 is greater than the other intensity of electric field $E_{S\text{-}D}$ between the developing sleeve 551 and the solid exposure section on the photoreceptor drum 410.

According to the abovementioned configuration of the developing device 500A, as well as the first embodiment, the resistance reduced carriers, among the carriers to be conveyed while adhering onto the circumferential surface of the developing sleeve 551, are forcibly moved towards the circumferential surface of the carrier adhering roller 571 at the opposing position between the developing sleeve 551 and the carrier adhering roller 571, so as to remove the resistance reduced carriers from the circumferential surface of the developing sleeve 551.

Further, since the carrier adhering roller 571 is disposed at such a position that is located upstream the opposing position, at which the developing sleeve 551 and the photoreceptor drum 410 oppose to each other, in the rotating direction of the developing sleeve 551, while maintaining a predetermined gap of 0.25 mm between the carrier adhering roller 571 and the developing sleeve 551, the thickness of the layer of the developer is regulated at a value within a predetermined range, and accordingly, it becomes possible to regulate the amount of the developer to be conveyed by the developing sleeve 551. In the second embodiment, the amount of the developer to be conveyed by the developing sleeve 551 is set at 200 g/m$^2$.

As abovementioned, even in the developing device 500A, the resistance reduced carrier, included in the two component developer constituted by toner and carriers and bone by the developing sleeve 551, are made to adhere to the recollection roller 572 through the carrier adhering roller 571, and then, are scraped off the recollection roller 572 by the scraper 573, so as to eject them outside the developing device 500A by activating the carrier ejecting screw 574.

As abovementioned, since the resistance reduced carriers can be removed from the developer residing in the developer accommodating chamber 513 through the developing sleeve 551, the carrier adhering roller 571, the recollection roller 572 and the carrier ejecting screw 574, it becomes possible to prevent the developing device 500A from occurrence of a defect (malfunction) caused by the resistance reduced carriers.

Further, since it is possible to regulate the thickness of the layer of the developer, currently adhering onto the circumferential surface of the developing sleeve 551 and being conveyed, within a predetermined range by the carrier adhering roller 571, which is disposed while maintaining a predetermined gap against the developing sleeve 551, without employing an exclusive regulating member, such as developer layer regulating member 555 employed in the developing device 500 serving as the first embodiment, or the like, it becomes possible to simplify the structure of the developing device.

The present inventors have confirmed that the image forming apparatus, embodied in the present invention, is effective for removing the resistance reduced carriers, as follows.

Embodiment 1 represents the image forming apparatus incorporating the developing device 500 embodied in the present invention as the first embodiment shown in FIG. 2.

The various kinds of conditions to be employed in Embodiment 1 are indicated as follows.

| | |
|---|---|
| Conveyance amount of developer to be conveyed by the developing sleeve 551 | 200 g/m$^2$ |
| Carrier adhering roller 571 | Presence |
| Recollection roller 572 | Presence |
| Developer layer regulating member 555 | Presence |
| Voltage to be applied to developing sleeve 551 | −500 V |
| Voltage to be applied to carrier adhering roller 571 | +200 V |
| Voltage to be applied to recollection roller 572 | +200 V |
| Gap between developing sleeve 551 and carrier adhering roller 571 | 0.25 mm |
| Gap between carrier adhering roller 571 and recollection roller 572 | 0.2 mm |
| Gap between developing sleeve 551 and developer layer regulating member 555 | 0.25 mm |

Further, the related conditions with respect to the photoreceptor drum 410 in Embodiment 1 are indicated as follows.

| | |
|---|---|
| Gap between photoreceptor drum 410 and developing sleeve 551 | 0.3 mm |
| Voltage of background area on photoreceptor drum 410 | −600 V |
| Voltage of solid exposure section on photoreceptor drum 410 | −100 V |

Embodiment 2 represents the image forming apparatus incorporating the developing device 500A embodied in the present invention as the second embodiment shown in FIG. 3.

The developing device 500A is constituted by excluding the developer layer regulating member 555 from the developing device 500 in Embodiment 1. The various kinds of conditions to be employed in Embodiment 2 are indicated as follows.

| | |
|---|---|
| Conveyance amount of developer to be conveyed by the developing sleeve 551 | 200 g/m$^2$ |
| Carrier adhering roller 571 | Presence |
| Recollection roller 572 | Presence |
| Developer layer regulating member 555 | Absence |
| Voltage to be applied to developing sleeve 551 | −500 V |
| Voltage to be applied to carrier adhering roller 571 | +200 V |
| Voltage to be applied to recollection roller 572 | +200 V |
| Gap between developing sleeve 551 and carrier adhering roller 571 | 0.25 mm |
| Gap between carrier adhering roller 571 and recollection roller 572 | 0.2 mm |

As indicated above, the conditions to be employed in Embodiment 2 are the same as those in Embodiment 1, except the absence of the developer layer regulating member 555.

Further, the related conditions with respect to the photoreceptor drum 410 in Embodiment 2 are indicated as follows.

| | |
|---|---|
| Gap between photoreceptor drum 410 and developing sleeve 551 | 0.3 mm |
| Voltage of background area on photoreceptor drum 410 | −600 V |
| Voltage of solid exposure section on photoreceptor drum 410 | −100 V |

The above-indicated conditions are the same as those in Embodiment 1.

Comparison example 1 is such an image forming apparatus that is constituted by replacing the developing device 500, installed in the image forming apparatus serving as the first embodiment shown in FIG. 1, with a developing device 500B detailed later. The developing device 500B is such a developing device that conducts the operation for replenishing the developer according to, so called, the trickle method, and will be detailed in the following.

Figure 4:
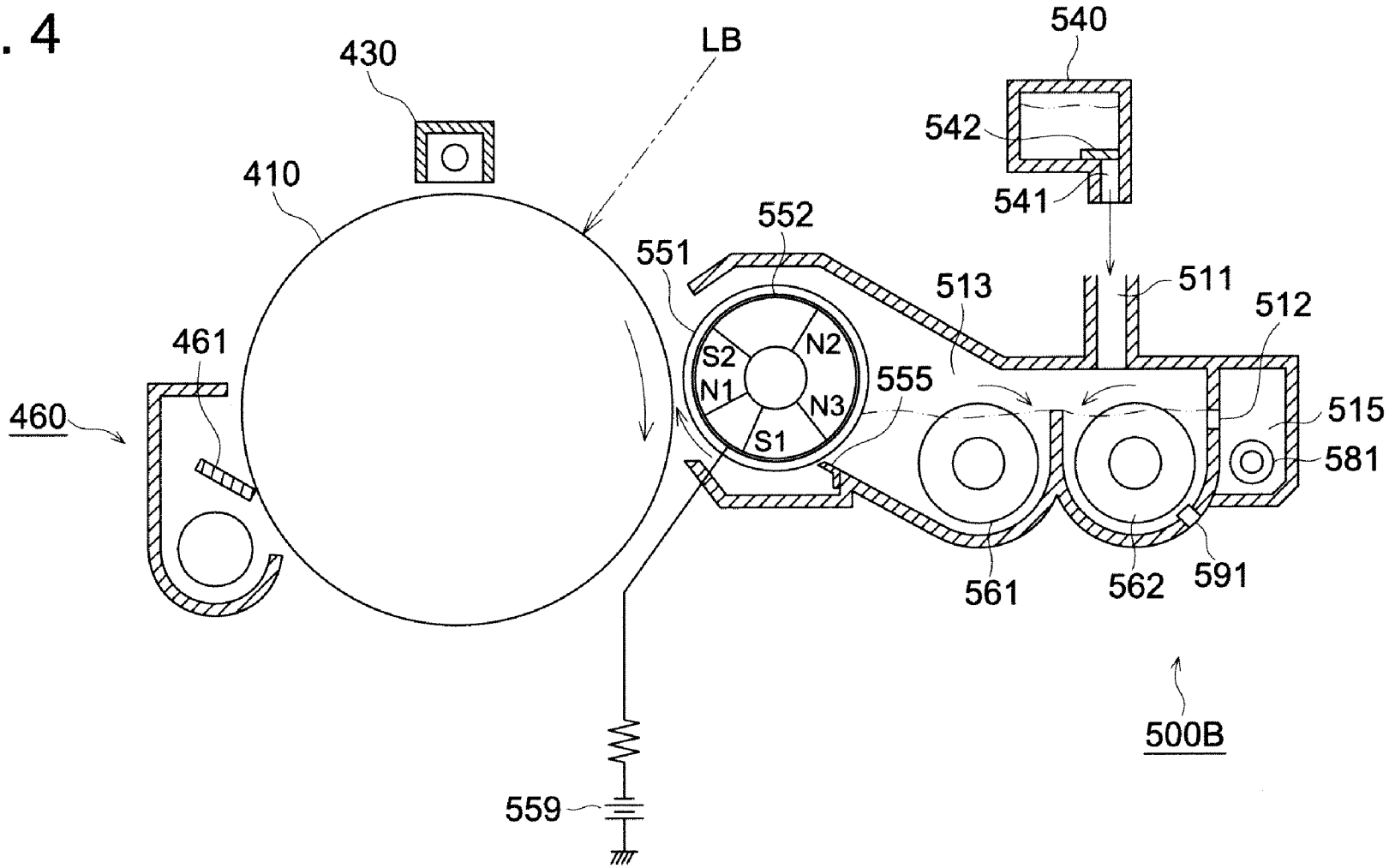
FIG. 4 shows an explanatory schematic diagram for explaining configurations and operations of a developing device to be incorporated in an image forming apparatus embodied in the present invention as the third embodiment.

FIG. 4 shows an explanatory schematic diagram for explaining the configurations and the operations of the developing device 500B.

As indicated in the schematic diagram shown in FIG. 4, the developing device 500B is constituted as described in the following.

In the developing device 500B, numeral 510 indicates a housing of the developing device 500, which includes a developer accommodating chamber 513 for accommodating the two components developer constituted by toner and carriers, therein, and also serving as an agitating chamber for agitating the two components developer accommodated in the chamber.

Further, disposed in the housing 510 are: a developing sleeve 551; a magnet roll 552 disposed inside the developing sleeve 551 so as to serve as a magnetic field generating member that includes plural magnetic poles; a developer layer regulating member 555 to regulate a thickness of a layer of the developer, to be currently conveyed, at a predetermined value; a pair of agitating screws 561, 562 to agitate the developer accommodated in the developer accommodating chamber 513; and a toner density detecting sensor 591 to detect a toner density of the developer currently accommodated in the developer accommodating chamber 513.

Still further, disposed in a right space of the schematic diagram shown in FIG. 4, are: a developer ejection opening 512 to eject excessive developer in the developer accommodating chamber 513 therefrom; a developer storing chamber 515 to store the excessive developer ejected from the developer ejection opening 512 therein; and a developer ejecting screw 581 to eject the excessive developer stored in the developer storing chamber 515.

Yet further, in an upper right space of the schematic diagram shown in FIG. 4, a developer hopper 540 to store the developer constituted by toner and carriers, which are mixed at a predetermined mixing ratio, therein, so as to feed the stored developer into the developer accommodating chamber 513 through a developer feeding path (not shown in the drawings) in response to the current status of the developer accommodated in the developer accommodating chamber 513. In this connection, in Comparison example 1, the mass ratio of toner and carriers, both included in the developer stored in the developer hopper 540, is set at the value indicated as follow.

Toner:Carriers=9:1

At the time when the toner density detecting sensor 591 detects the fact that the toner density in the developer accommodating chamber 513 has dropped (been consumed) to a level being lower than a predetermined toner density, the developer stored in the developer hopper 540 is fed into the developer accommodating chamber 513.

In the developing device 500B, at the time when the toner density detecting sensor 591 detects the fact that the toner density in the developer accommodating chamber 513 has been dropped to the level being equal to or smaller than the predetermined toner density by repeating the developing operation, a shutter 542, currently closing a developer emission opening 541, is activated to open the developer emission opening 541, so as to feed the developer accommodated in the developer hopper 540 to the developer accommodating chamber 513 through the developer feeding path (not shown in the drawings). By supplying the developer into the developer accommodating chamber 513, the ratio of toner included in the developer, currently residing in the developer accommodating chamber 513, is heightened, and as a result, the toner density increases.

Then, at the time when the toner density in the developer accommodating chamber 513 has reached to the level being equal to or greater than the predetermined toner density, the shutter 542, currently opening the developer emission opening 541, is activated to close the developer emission opening 541, so as to stop the toner feeding operation from the developer hopper 540.

The total amount of developer accommodated in the developer accommodating chamber 513 is increased by feeding the developer from the developer hopper 540, and accordingly, the upper level of the developer accommodated in the developer accommodating chamber 513 is elevated.

At the time when the upper level of the developer accommodated in the developer accommodating chamber 513 has reached to the level of the developer ejection opening 512, the developer overflows the developer ejection opening 512 into the developer storing chamber 515. The developer overflowed from the developer ejection opening 512 is stored in the developer storing chamber 515, and ejected outside the developing device 500B through a developer ejection path (not shown in the drawings) by activating the developer ejecting screw 581.

The developer, overflowing from the developer ejection opening 512 to the housing 510, is a mixture of toner and carriers accommodated in the developer accommodating chamber 513, and accordingly, includes both the resistance reduced carriers, resistances of which are reduced as a result of repeatedly using them for the developing operations, and the new carriers fed from the developer hopper 540.

In both the developing device 500 serving as the first embodiment of the present invention and the developing device 500B employed in the Comparison example 1, the contents and the configurations of the functional members, attached with the names and/or the reference numerals being common between both of them, are the same as each other. Accordingly, since the functions and the operations of them have been detailed in the foregoing while referring to the developing device 500, duplicated explanations will be omitted in the following.

The various kinds of conditions to be employed in Comparison example 1 are indicated as follows.

| | |
|---|---|
| Conveyance amount of developer to be conveyed by the developing sleeve 551 | 200 g/m$^2$ |
| Carrier adhering roller 571 | Absence |
| Recollection roller 572 | Absence |
| Voltage to be applied to developing sleeve 551 | −500 V |

Further, the related conditions with respect to the photoreceptor drum 410 in Comparison example 1 are indicated as follows.

| | |
|---|---|
| Gap between photoreceptor drum 410 and developing sleeve 551 | 0.3 mm |
| Voltage of background area on photoreceptor drum 410 | −600 V |
| Voltage of solid exposure section on photoreceptor drum 410 | −100 V |

The above-indicated conditions are the same as those in Embodiment 1.

Comparison example 2 is such an image forming apparatus that is constituted by replacing the developing device 500, installed in the image forming apparatus serving as the first embodiment shown in FIG. 1, with a developing device 500C detailed later. The developing device 500C is such a developing device that, by setting the skin potential (defined as a difference between the charge potential and the developing bias voltage) at a value larger than that to be employed for the normal image forming operation, the carriers, included in the developer currently conveyed to the developing region, are made to move toward the photoreceptor member. The developing device 500C will be detailed in the following.

Figure 5:
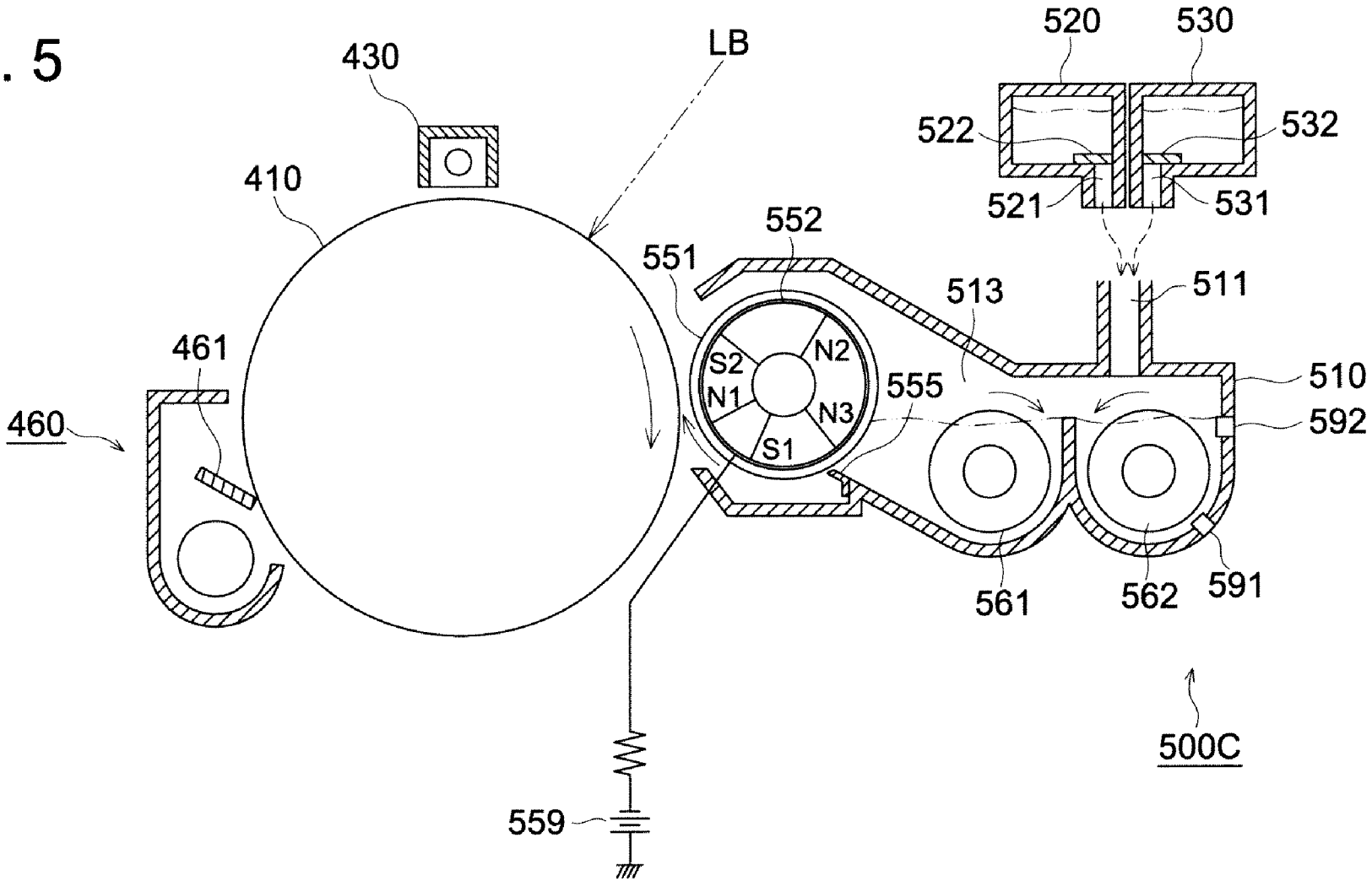
FIG. 5 shows an explanatory schematic diagram for explaining configurations and operations of a developing device to be incorporated in an image forming apparatus embodied in the present invention as the fourth embodiment.

FIG. 5 shows an explanatory schematic diagram for explaining the configurations and the operations of the developing device 500C.

As indicated in the schematic diagram shown in FIG. 4, the developing device 500C is constituted as described in the following.

In the developing device 500B, numeral 510 indicates a housing of the developing device 500, which includes a developer accommodating chamber 513 for accommodating the two components developer constituted by toner and carriers, therein, and also serving as an agitating chamber for agitating the two components developer accommodated in the chamber.

Further, disposed in the housing 510 are: a developing sleeve 551; a magnet roll 552 disposed inside the developing sleeve 551 so as to serve as a magnetic field generating member that includes plural magnetic poles; a developer layer regulating member 555 to regulate a thickness of a layer of the developer, to be currently conveyed, at a predetermined value; a pair of agitating screws 561, 562 to agitate the developer accommodated in the developer accommodating chamber 513; a toner density detecting sensor 591 to detect a toner density of the developer currently accommodated in the developer accommodating chamber 513; and a developer upper level detecting sensor 592 to detect the total amount of the developer currently accommodated in the developer accommodating chamber 513.

Based on the toner density in the developer accommodating chamber 513, detected by the toner density detecting sensor 591, new toner is fed into the developer accommodating chamber 513 from the toner hopper 520, indicated in an upper right space of the schematic diagram shown in FIG. 5, which stores fresh toner therein. Further, based on the upper level of the developer, detected by the developer upper level detecting sensor 592, new carriers are fed into the developer accommodating chamber 513 from the carrier hopper 530, which stores fresh carriers therein.

The various kinds of conditions to be employed in Comparison example 2 are indicated as follows.

| | |
|---|---|
| Conveyance amount of developer to be conveyed by the developing sleeve 551 | 200 g/m$^2$ |
| Carrier adhering roller 571 | Absence |
| Recollection roller 572 | Absence |
| Voltage to be applied to developing sleeve 551 | |
| Operation in image forming mode | −500 V |
| Operation in carrier ejecting mode | −500 V |

Further, the related conditions with respect to the photoreceptor drum 410 in Comparison example 2 are indicated as follows.

| | |
|---|---|
| Gap between photoreceptor drum 410 and developing sleeve 551 | 0.3 mm |
| Voltage on photoreceptor drum 410 | |
| Operation in image forming mode | |
| Background area | −600 V |
| Solid exposure section | −100 V |
| Operation in carrier ejecting mode | |
| Background area | −800 V |
| Solid exposure section | none |

In this connection, the image forming mode is defined as such a mode for conducting a normal image forming operation, namely, for conducting a normal developing operation, while the carrier ejecting mode is defined as such a mode for removing the resistance reduced carriers from the developer residing in the developer accommodating chamber 513.

In the carrier ejecting mode, the charging voltage is set at −800 V, while the image writing operation to be conducted by using the output light, emitted from the image writing section 300, is disabled. Further, by operating the photoreceptor drum 410 and the developing device 500C under the conditions as abovementioned, it is possible to make the resistance reduced carriers, which are included in the developer conveyed to the developing region by the developing sleeve 551 currently rotating, move onto the photoreceptor drum 410.

The first skin potential (defined as a difference between the charge potential of the photoreceptor drum 410 and the developing bias voltage to be applied to the developing sleeve 551) in the normal image forming mode can be found as follow, $$-600-(-500)=-100,$$

while the second skin potential in the carrier ejecting mode can be found as follow, $$-800-(-500)=-300.$$

Accordingly, since the absolute value of the second skin potential is greater than that of the first skin potential, it is possible to shift the resistance reduced carriers, included in the developer conveyed to the developing region by the developing sleeve 551 currently rotating, onto the photoreceptor drum 410.

As abovementioned, according to Comparison example 2, when the developing device 500C is operated in the carrier ejecting mode, it is possible to remove the resistance reduced carriers from the developer residing in the developer accommodating chamber 513 through the developing sleeve 551 and the photoreceptor drum 410. Successively, the resistance reduced carriers moved onto the photoreceptor drum 410 are scraped off the circumferential surface of the photoreceptor drum 410 by the cleaning blade 461 of the cleaning device 460.

In this connection, according to Comparison example 2, since the charge potential of the photoreceptor drum 410 in the carrier ejecting mode is different from that in the image forming mode, it is impossible to simultaneously implement the carrier ejecting mode in parallel with the image forming mode, and accordingly, the image forming operation cannot be conducted during activating the carrier ejecting mode. Owing to the abovementioned drawback, it is preferable that the image forming apparatus of Comparison example 2 is so constituted that the image forming operation is usually conducted in the image forming mode, and at only the time when the predetermined conditions are fulfilled, the apparatus is operated in the carrier ejecting mode. For instance, it is preferable that the image forming apparatus of Comparison example 2 is so constituted that, every time when the image forming operations for printing images onto a predetermined number of paper sheets have completed, the apparatus operating mode is changed from the image forming mode to the carrier ejecting mode so as to operate the apparatus in the carrier ejecting mode for a predetermined time interval, and then, the apparatus is again operated in the image forming mode, so as to repeat the abovementioned processes.

Comparison example 3 is such an image forming apparatus that implements the carrier ejecting mode under the conditions being different from those employed in the image forming apparatus of Comparison example 2 aforementioned, so as to shift the resistance reduced carriers, included in the developer conveyed to the developing region, onto the photoreceptor member, and to remove them from the photoreceptor member concerned.

The various kinds of conditions to be employed in Comparison example 3 are indicated as follows.

| | |
|---|---|
| Carrier adhering roller 571 | Absence |
| Recollection roller 572 | Absence |
| Voltage to be applied to developing sleeve 551 | |
| Operation in image forming mode | −500 V |
| Operation in carrier ejecting mode | −800 V |

Further, the related conditions with respect to the photoreceptor drum 410 in Comparison example 3 are indicated as follows.

| | |
|---|---|
| Gap between photoreceptor drum 410 and developing sleeve 551 | 0.3 mm |
| Voltage on photoreceptor drum 410 | |
| Operation in image forming mode | |
| Background area | −600 V |
| Solid exposure section | −100 V |
| Operation in carrier ejecting mode | |
| Background area | −900 V |
| Solid exposure section | none |

In the carrier ejecting mode of Comparison example 3, the voltage to be applied to developing sleeve 551 by the bias voltage source 559 is set at −800 V. Further, the charging voltage of the photoreceptor drum 410 is set at −900 V, while the image writing operation to be conducted by using the output light, emitted from the image writing section 300, is disabled. Further, by operating the photoreceptor drum 410 and the developing device 500C under the conditions as abovementioned, it is possible to make the resistance reduced carriers, which are included in the developer conveyed to the developing region by the developing sleeve 551 currently rotating, move onto the photoreceptor drum 410.

As abovementioned, according to Comparison example 3, when the developing device 500C is operated in the carrier ejecting mode, it is possible to remove the resistance reduced carriers from the developer residing in the developer accommodating chamber 513 through the developing sleeve 551 and the photoreceptor drum 410. Successively, the resistance reduced carriers moved onto the photoreceptor drum 410 are scraped off the circumferential surface of the photoreceptor drum 410 by the cleaning blade 461 of the cleaning device 460.

In this connection, according to Comparison example 3, since the charge potential of the photoreceptor drum 410 in the carrier ejecting mode is different from that in the image forming mode, it is impossible to simultaneously implement the carrier ejecting mode in parallel with the image forming mode, and accordingly, the image forming operation cannot be conducted during activating the carrier ejecting mode. Owing to the abovementioned drawback, it is preferable that the image forming apparatus of Comparison example 3 is so constituted that the image forming operation is usually conducted in the image forming mode, and at only the time when the predetermined conditions are fulfilled, the apparatus is operated in the carrier ejecting mode. For instance, it is preferable that the image forming apparatus of Comparison example 3 is so constituted that, every time when the image forming operations for printing images onto a predetermined number of paper sheets have completed, the apparatus operating mode is changed from the image forming mode to the carrier ejecting mode so as to operate the apparatus in the carrier ejecting mode for a predetermined time interval, and then, the apparatus is again operated in the image forming mode, so as to repeat the abovementioned processes.

With respect to each of the Embodiments 1 and 2, and Comparison examples 1, 2 and 3, the operation for continuously making printouts of a predetermined pattern is conducted as the comparison test for confirming whether or not the resistance reduced carriers can be appropriately ejected.

Test Conditions

| | |
|---|---|
| Printing pattern | ratio of printing: 5% |
| Paper sheet size | A4 |
| Number of printouts | $200 \times 10^3$ sheets (continuous) |
| Conveyance amount of developer to be conveyed by the developing sleeve 551 | 200 g/m$^2$ |

In this connection, in each of Comparison examples 1 and 2, by repeating the operations for changing the image forming mode to the carrier ejecting mode and implementing the carrier ejecting mode for 20 seconds every time when the image forming operations for 500 paper sheets have been completed, the total number of $200\times10^3$ paper sheets were printed as the printouts.

<Contents and Method of Evaluation>

Carrier Adhesion onto Solid Image Area

The resistance reduced carriers are liable to adhere onto the solid image area. The large amount of carrier adhesion onto the solid image area represents the fact that the ratio of resistance reduced carriers in the developer is high. In the comparison test, through the printing process of $200\times10^3$ paper sheets, the A3 size paper sheets were employed for printing the first page, the $50\times10^3$-th paper sheet, the $100\times10^3$-th paper sheet, the $150\times10^3$-th paper sheet and the $200\times10^3$-th paper sheet, and with respect to each of the paper sheet concerned, a number of carriers adhering onto the solid image area was confirmed (counted) by conducting the visual inspection, so as to evaluate the A3 sized printout having the number of carriers equal to or smaller than 10 carriers at "G" (Good), while that greater than 10 carriers at "B" (Bad).

Carrier Replenishment Amount when Implementing Operations for Printing $200\times10^3$ Paper Sheets When the resistance reduced carriers included in the developer are ejected outside the developing device, it becomes necessary to supply new carriers so as to replenish the resistance reduced carriers ejected. In the comparison test, the operations for printing the $200\times10^3$ paper sheets were implemented by dividing the $200\times10^3$ paper sheets into plural groups, each of which includes $50\times10^3$ paper sheets, so as to measure and evaluate the toner replenishment amount for every time when the operations for printing the $50\times10^3$ paper sheets had completed. In this connection, in Comparison example 1, in which the developer to be supplied is the mixture of toner and carriers formed by mixing them at the mass ratio of "toner:carriers=9:1" as aforementioned, since the operation for independently supplying the carriers only is not implemented, the carrier replenishment amount was calculated by multiplying the developer replenishment amount, measured for every time when the operations for printing the $50\times10^3$ paper sheets had completed, by the ratio of carriers included in the developer concerned.

Toner Replenishment Amount when Implementing Operations for Printing $200\times10^3$ Paper Sheets When the toner is consumed by implementing the printing (developing) operation, new toner being equivalent to the amount of toner consumed is replenished. The large amount of toner replenishment implies the possibility that the toner is consumed due to a factor other than the implementation of the printing (developing) operation. For instance, as the example that the toner is consumed due to the factor other than the implementation of the printing (developing) operation, sometimes, toner would be also ejected in the process of ejecting the resistance reduced carriers. In the comparison test, the operations for printing the $200\times10^3$ paper sheets were implemented by dividing the $200\times10^3$ paper sheets into plural groups, each of which includes $50\times10^3$ paper sheets, so as to measure and evaluate the toner replenishment amount for every time when the operations for printing the $50\times10^3$ paper sheets had completed. In this connection, in Comparison example 1, in which the developer to be supplied is the mixture of toner and carriers formed by mixing them at the mass ratio of "toner:carriers=9:1" as aforementioned, since the operation for independently supplying the carriers only is not implemented, the carrier replenishment amount was calculated by multiplying the developer replenishment amount, measured for every time when the operations for printing the $50\times10^3$ paper sheets had completed, by the ratio of carriers included in the developer concerned.

Value of Electric Current Flowing Through Ejected Carriers

It was evaluated whether or not the ejected carriers were resistance reduced carriers by determining whether an electric current to be flown through the ejected carriers under a predetermined condition was large or small. When the ratio of normal carriers included in the ejected carriers is high, the electric resistance of the ejected carriers also becomes high, and accordingly, the electric current to be flown through the ejected carriers becomes small. On the other hand, when the ratio of normal carriers included in the ejected carriers is low, the electric resistance of the ejected carriers also becomes low, and accordingly, the electric current to be flown through the ejected carriers becomes large.

Figure 6:
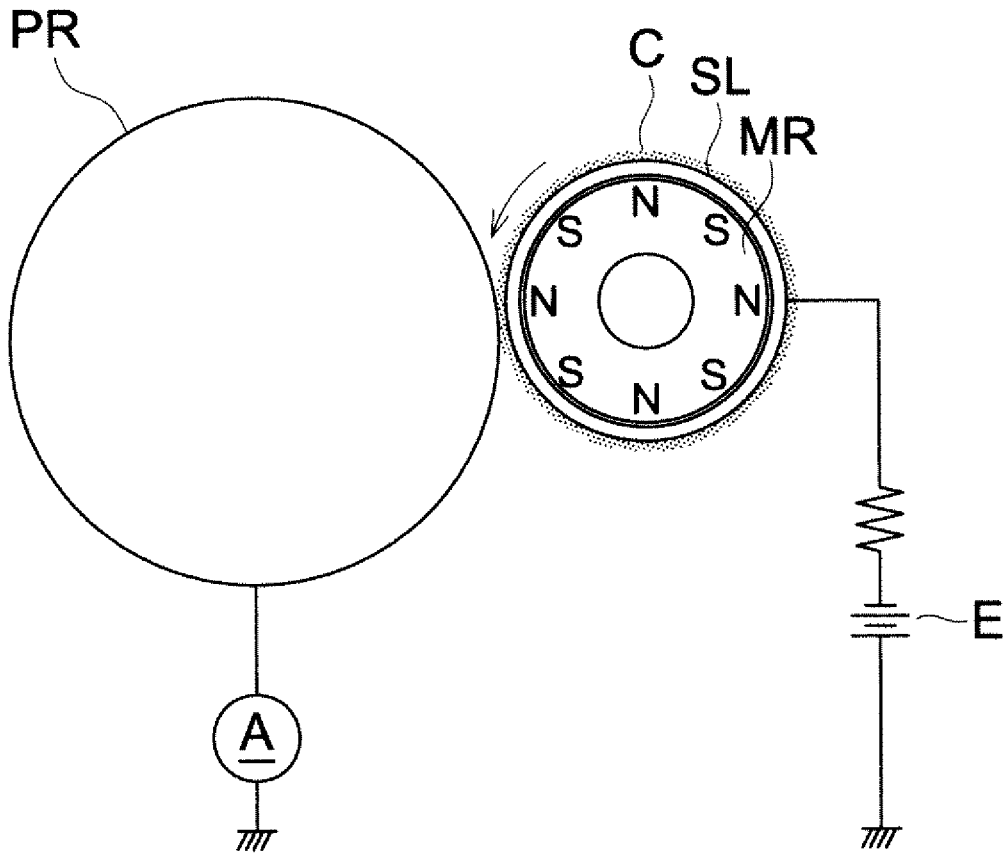
FIG. 6 shows a conceptual schematic diagram indicating an electric current measuring device, which is employed for measuring an electric current flowing through carriers.

FIG. 6 shows a conceptual schematic diagram indicating an electric current measuring device, which was employed for measuring the electric current flowing through the carriers.

As shown in FIG. 6, the electric current measuring device is provided with a sleeve SL including a magnetic roller MR that serves as a magnetic field generating member having a plurality of fixed magnetic poles, therein, and an opposing electrode PR. The outer diameter of the sleeve SL is set at 20 mm, while the magnetized length of the magnetic roller MR is set at 50 mm. Further, the outer diameter of the opposing electrode PR is set at 30 mm, while the length of the opposing electrode PR is set at 60 mm. Still further, the minimum near distance between the sleeve SL and the opposing electrode PR is set at 0.4 mm. Yet further, a DC electric power source E applies the DC voltage of 500 volts to a gap between the sleeve SL and the opposing electrode PR. In FIG. 6, symbol A indicates a DC electric current meter, provided for making it possible to measure a value of the electric current flowing from the sleeve SL to the opposing electrode PR.

Then, in such a state that the sleeve SL bears carriers C, currently serving as the measuring object, on its circumferential surface, and making the sleeve SL rotate at a rotation velocity of 300 rpm, the value of the electric current, flowing from the sleeve SL to the opposing electrode PR through the carriers C borne by the circumferential surface of the sleeve SL, is measured by using the DC electric current meter A.

When the electric resistance of the carriers C, borne by the sleeve SL, is high, the value of electric current flowing into the opposing electrode PR becomes small, while when the electric resistance of the carriers C is low, the value of the electric current flowing into the opposing electrode PR becomes large. Accordingly, the small or large of the value of the electric current concerned represents the high or low of the electric resistance of the carriers C. As a result of the measurement conducted by employing the electric current measuring device shown in FIG. 6 in regard to new carriers whose electric resistances have not reduced, the value of the electric current flowing through such the new carriers was 10 micro amperes (μA).

The fact that the value of the electric current is large, namely, the electric resistances of the carriers C borne on the sleeve SL are low, implies that ratio of normal carriers included in the carriers C is small, namely, the ratio of resistance reduced carriers included in the carriers C is large. On the other hand, the fact that the value of the electric current is small, namely, the electric resistances of the carriers C borne on the sleeve SL are high, implies that ratio of normal carriers included in the carriers C is large, namely, the ratio of resistance reduced carriers included in the carriers C is small.

In the comparison test, during the time when the printing operations sifted from the $150\times10^3$-th paper sheet to $200\times10^3$-th paper sheet, sample carriers of 2 grams were extracted from the carriers ejected from each of Embodiment 1, Embodiment 2, Comparison example 1, Comparison example 2 and Comparison example 3, and the sleeve SL was made to bear the sample carriers of 2 grams so as to measure the value of the electric current, flowing from the sleeve SL to the opposing electrode PR through the sample carriers by using the DC electric current meter A. In this connection, in Comparison example 1 and Comparison example 3, since the toner was also ejected in association with the carriers, the measurement was conducted by extracting only the carriers from the mixture of toner and carriers. Further, as a result of the measurement conducted by employing the electric current measuring device shown in FIG. 6 in regard to new carriers whose electric resistances have not reduced, the value of the electric current flowing through such the new carriers was 10 micro amperes (μA).

The results of the comparison test will be indicated in the following.

TABLE 1

| | | Embodiments | | Comparison examples | | |
|---|---|---|---|---|---|---|
| | | 1 | 2 | 1 | 2 | 3 |
| Number of Prints | $50 \times 10^3$ | Good | Good | Good | Good | Good |
| | $100 \times 10^3$ | Good | Good | Good | Good | Good |
| | $150 \times 10^3$ | Good | Good | Bad | Bad | Good |
| | $200 \times 10^3$ | Good | Good | Bad | Bad | Good |
| Evaluation | | Good | Good | Bad | Bad | Good |

Table 1 indicates results of confirming the carrier adhesion state on the solid image area. As indicated in Table 1, with respect to Embodiment 1, Embodiment 2 and Comparison example 3, none of defect in which more than ten carriers adhered onto the solid image area had occurred through the implementation of printing the $200\times10^3$ paper sheets. In other words, it can be say that an occurrence of the defect caused by the resistance reduced carriers was sufficiently suppressed during the implementation of printing the $200\times10^3$ paper sheets, and the resistance reduced carriers were appropriately removed from the developer concerned. On the other hand, with respect to Comparison example 1 and Comparison example 2, occurrences of the defect in which more than ten carriers adhered onto the solid image area had been confirmed at the $150\times10^3$-th printed paper sheet and the $200\times10^3$-th printed paper sheet, respectively. Accordingly, it can be say that the defects caused by the resistance reduced carriers were occurred during the implementation of printing the $200\times10^3$ paper sheets in both Comparison example 1 and Comparison example 2, respectively, and the resistance reduced carriers were not appropriately removed from the developer concerned. Therefore, from the view point of the carrier adhesion onto the solid image area, Embodiment 1, Embodiment 2 and Comparison example 3 can be evaluated as "Good", while Comparison example 1 and Comparison example 2 can be evaluated as "Bad" in comparison with Embodiment 1, Embodiment 2 and Comparison example 3.

TABLE 2

| | | Embodiments | | Comparison examples | | |
|---|---|---|---|---|---|---|
| | | 1 | 2 | 1 | 2 | 3 |
| Number of Prints | $1\text{-}50 \times 10^3$ | 35 | 34 | 100 | 121 | 36 |
| | $50 \times 10^3\text{-}100 \times 10^3$ | 45 | 44 | 103 | 130 | 43 |
| | $100 \times 10^3\text{-}150 \times 10^3$ | 52 | 50 | 104 | 136 | 50 |
| | $150 \times 10^3\text{-}200 \times 10^3$ | 53 | 54 | 102 | 148 | 55 |
| | Evaluation | Good | Good | Bad | Bad | Good |

Table 2 indicates results of confirming the carrier replenishment amounts during the implementations of printing the $200\times10^3$ paper sheets. As indicated in Table 2, with respect to each of Embodiment 1, Embodiment 2 and Comparison example 3, the amount (mass) of new carriers, replenished during each of the implementations for printing $50\times10^3$ paper sheets, being an incremental implementation unit in the implementation process of printing $200\times10^3$ paper sheets, was in a range of 34-55 grams, while, with respect to Comparison example 1, that was in a range of 100-104 grams, and with respect to Comparison example 2, that was in a range of 121-148 grams. It can be considered that, in Comparison example 1 and Comparison example 2 in which the carrier replenishment amounts were great, in addition to the resistance reduced carriers, the carriers other than the resistance reduced carriers were also ejected during the implementation of printing. Accordingly, from the carrier replenishment amount point of view, namely, from the view point of evaluating the fact that the carriers other than the resistance reduced carriers have been ejected in the process of ejecting the resistance reduced carriers, Embodiment 1, Embodiment 2 and Comparison example 3 can be evaluated as "Good", while Comparison example 1 and Comparison example 2 can be evaluated as "Bad".

TABLE 3

| | Embodiments | | Comparison examples | | |
|---|---|---|---|---|---|
| | 1 | 2 | 1 | 2 | 3 |
| Electric current | 55 | 53 | 12 | 15 | 52 |
| Evaluation | Good | Good | Bad | Bad | Good |

Table 3 indicates results of measuring the electric currents flowing through the carriers during the implementations of printing the $200\times10^3$ paper sheets. As aforementioned, the value of the electric current, flowing through the new carriers and measured under the same measuring condition, was 10 microamperes (μA). As indicated in Table 3, with respect to Embodiment 1, Embodiment 2 and Comparison example 3, the electric currents flowing through the ejected carriers were in a range of 52-55 μA, while, with respect to Comparison example 1 and Comparison example 2, those were in a range of 12-15 μA. The electric current concerned in each of Comparison example 1 and Comparison example 2 was nearly equal to that of the new carriers, namely, the value of the electric current flowing through the carriers whose resistances have not reduced (10 μA), while, in each of Embodiment 1, Embodiment 2 and Comparison example 3, the value of the electric current was approximately five times of that of the new carriers. Accordingly, the ratio of the carriers, whose resistances have not reduced and which are included in the ejected carriers in each of Comparison example 1 and Comparison example 2, is different from that in each of Embodiment 1, Embodiment 2 and Comparison example 3. Accordingly, it can be say that the ratio of the carriers, whose resistances have not reduced and which are included in the ejected carriers in each of Comparison example 1 and Comparison example 2, is large, while the ratio of the carriers, whose resistances have not reduced and which are included in the ejected carriers in each of Embodiment 1, Embodiment 2 and Comparison example 3, is small, namely, the ratio of resistance reduced carriers is large. Therefore, from the resistance reduced carriers ejecting point of view, Embodiment 1, Embodiment 2 and Comparison example 3 can be evaluated as "Good", while Comparison example 1 and Comparison example 2 can be evaluated as "Bad".

TABLE 4

| | | Embodiments | | Comparison examples | | |
|---|---|---|---|---|---|---|
| | | 1 | 2 | 1 | 2 | 3 |
| Number of Prints | $1\text{-}50 \times 10^3$ | 900 | 890 | 900 | 910 | 1640 |
| | $50 \times 10^3\text{-}100 \times 10^3$ | 940 | 950 | 930 | 940 | 1590 |
| | $100 \times 10^3\text{-}150 \times 10^3$ | 930 | 940 | 940 | 950 | 1720 |
| | $150 \times 10^3\text{-}200 \times 10^3$ | 960 | 950 | 920 | 935 | 1680 |
| | Evaluation | Good | Good | Good | Good | Bad |

Table 4 indicates results of confirming the toner replenishment amounts during the implementations of printing the $200\times10^3$ paper sheets. As indicated in Table 4, with respect to each of Embodiment 1, Embodiment 2, Comparison example 1 and Comparison example 2, the amount (mass) of new toner, replenished during each of the implementations for printing $50\times10^3$ paper sheets, being an incremental implementation unit in the implementation process of printing $200\times10^3$ paper sheets, was in a range of 890-960 grams, while, with respect to Comparison example 3, that was in a range of 100-104 grams. With respect to Comparison example 3, since toner is ejected in association with the resistance reduced carriers, the toner replenishment amount becomes large. Therefore, from the toner replenishment amount point of view, namely, from the view point of evaluating the fact that the toner has been ejected in association with the resistance reduced carriers, Embodiment 1, Embodiment 2, Comparison example 1 and Comparison example 2 can be evaluated as "Good", while Comparison example 3 can be evaluated as "Bad".

TABLE 5

| | Embodiments | | Comparison examples | | |
|---|---|---|---|---|---|
| | 1 | 2 | 1 | 2 | 3 |
| Selective ejection of resistance reduced carriers | Good | Good | Bad | Bad | Good |
| Ejection of normal carriers in association with ejection of resistance reduced carriers | Good | Good | Bad | Bad | Good |
| Ejection of toner in association with ejection of resistance reduced carriers | Good | Good | Good | Good | Bad |
| Evaluation | Good | Good | Bad | Bad | Bad |

Table 5 indicates results of consolidating the aforementioned evaluation results, individually acquired item by item, into the total evaluation results. From the view point of evaluating the fact that the carriers other than the resistance reduced carriers have been ejected in the process of ejecting the resistance reduced carriers, Embodiment 1, Embodiment 2 and Comparison example 3 are superior to Comparison example 1 and Comparison example 2, and accordingly, Embodiment 1, Embodiment 2 and Comparison example 3 are evaluated as "Good", while Comparison example 1 and Comparison example 2 are evaluated as "Bad". Further, from the view point of evaluating the fact that the toner has been ejected in association with the resistance reduced carriers, Embodiment 1, Embodiment 2, Comparison example 1 and Comparison example 2 are superior to Comparison example 3, and accordingly, Embodiment 1, Embodiment 2, Comparison example 1 and Comparison example 2 are evaluated as "Good", while Comparison example 3 is evaluated as "Bad". Accordingly, as the total evaluations, Embodiment 1 and Embodiment 2 are superior to Comparison example 1, Comparison example 2 and Comparison example 3, and therefore, Embodiment 1 and Embodiment 2 are evaluated as "Good", while Comparison example 1, Comparison example 2 and Comparison example 3 are evaluated as "Bad".

As described in the foregoing, it have confirmed that, according to any one of Embodiment 1 and Embodiment 2 of the present invention, it becomes possible to remove the resistance reduced carriers included in the developer without abandoning the normal carriers whose resistances have not reduced, even in mid course of implementing the image forming operation, and therefore, the effectiveness of the present invention has been confirmed.

According to the present invention, it becomes possible to provide such an image forming apparatus that makes it possible not only to remove the resistance reduced carriers included in the developer without abandoning the normal carriers whose resistances have not reduced, while implementing the image forming operations, but also to eliminate malfunctions caused by the resistance reduced carriers included in the developer.

While the preferred embodiments of the present invention have been described using specific teen, such description is for illustrative purpose only, and it is to be understood that changes and variations may be made without departing from the spirit and scope of the appended claims.

What is claimed is:

1. An image forming apparatus that is provided with a photoreceptor member that rotates while bearing an electrostatic latent image thereon, and a developing device to develop the electrostatic latent image formed on the photoreceptor member, comprising:

a developer conveyance member, rotatably disposed inside the developing device in such a manner that the developer conveyance member and the photoreceptor member oppose to each other at a first opposing position while placing a first predetermined gap between them, and bearing developer constituted by toner and carriers, thereon, so as to convey the developer to the first opposing position, wherein the electrostatic latent image, borne on the photoreceptor member, is developed at the first opposing position between the photoreceptor member and the developer conveyance member, by shifting the toner included in the developer, borne on the developer conveyance member, onto the photoreceptor member in response to a first electric field generated at the first predetermined gap between the photoreceptor member and the developer conveyance member;

a carrier adhering roller, rotatably disposed in such a manner that the carrier adhering roller and the developer conveyance member oppose to each other at a second opposing position while placing a second predetermined gap between them, so as to make at least a part of the carriers, included in the developer currently borne on the developer conveyance member, shift and adhere onto the carrier adhering roller in response to a second electric field generated at the second predetermined gap between the developer conveyance member and the carrier adhering roller;

a recollection roller, rotatably disposed in such a manner that the recollection roller and the carrier adhering roller oppose to each other at a third opposing position while placing a third predetermined gap between them, to generate a magnetic field at the third opposing position so as to attract adhered carriers, currently adhered onto the carrier adhering roller, onto a circumferential surface of the recollection roller; and a scraping member, contacting the recollection roller, to scrape the adhered carriers off the circumferential surface of the recollection roller.

2. The image forming apparatus of claim 1, wherein the second opposing position is located upstream the first opposing position in a rotating direction of the developer conveyance member.

3. The image forming apparatus of claim 1, wherein a strength of the second electric field to be applied to the second predetermined gap, located at the second opposing position, is set at such a value that is greater than that of the first electric field to be generated between a solid exposure section of the photoreceptor member and the developer conveyance member.

4. The image forming apparatus of claim 1, wherein an amount of developer to be borne and conveyed by the photoreceptor member is regulated by the carrier adhering roller.

5. The image forming apparatus of claim 1, wherein the carrier adhering roller is made of a nonmagnetic material.

6. The image forming apparatus of claim 1, wherein the recollection roller rotates in a direction reverse to a rotating direction of the carrier adhering roller, at the third opposing position.

7. The image forming apparatus of claim 1, wherein the scraping member is an elastic plate-shaped member.

8. A carrier recollecting method, which is to be employed for an image forming apparatus that is provided with a photoreceptor member that rotates while bearing an electrostatic latent image thereon, and a developing device that includes a developer conveyance member, rotatably disposed inside the developing device in such a manner that the developer conveyance member and the photoreceptor member oppose to each other at a first opposing position while placing a first predetermined gap between them, and bearing developer constituted by toner and carriers, thereon, so as to convey the developer to the first opposing position, wherein the electrostatic latent image, borne on the photoreceptor member, is developed at the first opposing position between the photoreceptor member and the developer conveyance member, by shifting the toner included in the developer, borne on the developer conveyance member, onto the photoreceptor member in response to a first electric field generated at the first predetermined gap between the photoreceptor member and the developer conveyance member, the carrier recollecting method comprising:

making at least a part of the carriers, included in the developer currently borne on the developer conveyance member, shift and adhere onto a carrier adhering roller, rotatably disposed in such a manner that the carrier adhering roller and the developer conveyance member oppose to each other at a second opposing position while placing a second predetermined gap between them, in response to a second electric field generated at the second predetermined gap between the developer conveyance member and the carrier adhering roller;

attracting adhered carriers, currently adhered onto the carrier adhering roller, onto a circumferential surface of a recollection roller, rotatably disposed in such a manner that the recollection roller and the carrier adhering roller oppose to each other at a third opposing position while placing a third predetermined gap between them, and generating a magnetic field at the third opposing position; and scraping the adhered carriers off the circumferential surface of the recollection roller by employing a scraping member currently contacting the recollection roller.

9. The carrier recollecting method of claim 8, wherein the second opposing position is located upstream the first opposing position in a rotating direction of the developer conveyance member.

10. The carrier recollecting method of claim 8, wherein a strength of the second electric field to be applied to the second predetermined gap, located at the second opposing position, is set at such a value that is greater than that of the first electric field to be generated between a solid exposure section of the photoreceptor member and the developer conveyance member.

* * * * *